US008833921B2

(12) United States Patent
Kihira et al.

(10) Patent No.: US 8,833,921 B2
(45) Date of Patent: Sep. 16, 2014

(54) THIN-FILM FORMING APPARATUS, THIN-FILM FORMING METHOD, PIEZOELECTRIC-ELEMENT FORMING METHOD, DROPLET DISCHARGING HEAD, AND INK-JET RECORDING APPARATUS

(75) Inventors: Takakazu Kihira, Kanagawa (JP); Yoshikazu Akiyama, Kanagawa (JP); Osamu Machida, Kanagawa (JP); Masahiro Yagi, Kanagawa (JP); Ryoh Tashiro, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 206 days.

(21) Appl. No.: 13/194,230

(22) Filed: Jul. 29, 2011

(65) Prior Publication Data

US 2012/0026249 A1 Feb. 2, 2012

(30) Foreign Application Priority Data

Jul. 30, 2010 (JP) ..... 2010-173107
Jul. 30, 2010 (JP) ..... 2010-173111
Mar. 18, 2011 (JP) ..... 2011-061625

(51) Int. Cl.
*B41J 2/01* (2006.01)
*B41J 11/00* (2006.01)
*B41J 3/407* (2006.01)

(52) U.S. Cl.
CPC ..... *B41J 11/002* (2013.01); *B41J 11/0015* (2013.01); *B41J 3/407* (2013.01)
USPC ..... 347/102; 347/101; 347/68

(58) Field of Classification Search
CPC ..... B41J 11/002; B41J 11/0015; B41J 2/1607
USPC ..... 347/102, 101, 68
See application file for complete search history.

(56) References Cited

U.S. PATENT DOCUMENTS

2003/0030689 A1* 2/2003 Hashimoto et al. ..... 347/20
2004/0009303 A1* 1/2004 Ito et al. ..... 427/421

(Continued)

FOREIGN PATENT DOCUMENTS

CN 1840334 A 10/2006
CN 1982921 A 6/2007

(Continued)

OTHER PUBLICATIONS

Amit Kumar et al., "Features of gold having micrometer to centimeter dimensions can be formed through a combination of stamping with an elastomeric stamp and an alkanethiol "ink" followed by chemical etching", Appl. Phys. Lett., vol. 63, No. 14, Oct. 4, 1993, pp. 2002-2004.

(Continued)

*Primary Examiner* — Henok Legesse
(74) *Attorney, Agent, or Firm* — Oblon, Spivak, McClelland, Maier & Neustadt, L.L.P.

(57) ABSTRACT

A thin-film forming apparatus for forming a thin film on a substrate by using an ink-jet method includes an ink applying unit that applies an ink drop for thin-film formation to a predetermined area on a surface of the substrate; at least one laser light source for heating the ink drop thereby forming a thin film; and a laser-light irradiating unit that irradiates, with a laser light from the laser light source, a first spot positioned on a back side of the predetermined area of the substrate to which the ink drop has been applied.

20 Claims, 14 Drawing Sheets

(56) References Cited

U.S. PATENT DOCUMENTS

| | | | | |
|---|---|---|---|---|
| 2004/0226929 | A1* | 11/2004 | Miura et al. | 219/121.85 |
| 2008/0193672 | A1 | 8/2008 | Miura | |
| 2010/0002042 | A1* | 1/2010 | Takatsuka | 347/20 |
| 2011/0090289 | A1* | 4/2011 | Mizukami | 347/68 |

FOREIGN PATENT DOCUMENTS

| | | |
|---|---|---|
| CN | 101244650 B | 6/2011 |
| JP | 2007-105661 | 4/2007 |
| JP | 2007-152250 | 6/2007 |
| JP | 4232753 | 12/2008 |
| JP | 4353145 | 8/2009 |

OTHER PUBLICATIONS

K. D. Budd et al., "Sol-Gel Processing of $PbTiO_3$, $PbZrO_3$, PZT, and PLZT Thin Films", Proc. Brit. Cerm. Soc., vol. 36, 1985, pp. 107-121.

The First Office Action in corresponding Chinese Patent Application No. 201110214831.5, Issuing Date: Nov. 12, 2013 with English translation.

* cited by examiner

PHOTOGRAPH TAKEN IN MEASUREMENT OF
WATER CONTACT ANGLE SHOWS THAT
WATER CONTACT ANGLE ON SAM-FILM FORMED PORTION WAS 92.2°

PHOTOGRAPH TAKEN IN MEASUREMENT OF
WATER CONTACT ANGLE SHOWS THAT
WATER CONTACT ANGLE ON SAM REMOVED PORTION WAS 5°

THIN-FILM FORMING APPARATUS, THIN-FILM FORMING METHOD, PIEZOELECTRIC-ELEMENT FORMING METHOD, DROPLET DISCHARGING HEAD, AND INK-JET RECORDING APPARATUS

CROSS-REFERENCE TO RELATED APPLICATIONS

The present application claims priority to and incorporates by reference the entire contents of Japanese Patent Application No. 2010-173107 filed in Japan on Jul. 30, 2010, Japanese Patent Application No. 2010-173111 filed in Japan on Jul. 30, 2010 and Japanese Patent Application No. 2011-061625 filed in Japan on Mar. 18, 2011.

BACKGROUND OF THE INVENTION

1. Field of the Invention

The present invention relates to a thin-film forming apparatus, a thin-film forming method, a piezoelectric-element forming method, a droplet discharging head, and an ink-jet recording apparatus.

2. Description of the Related Art

Conventionally, a droplet discharging head of an ink-jet recording apparatus used as an image recording apparatus or image forming apparatus, such as a printer, a facsimile machine, and a copier, includes a nozzle for discharging an ink drop, a pressurizing chamber (also referred to as an ink flow path, a pressurizing liquid chamber, a pressure chamber, a discharge chamber, or a liquid chamber, and the like.) into which the nozzle leads, and a structure to pressurize ink in the pressurizing chamber, and discharges an ink drop from the nozzle by pressurizing the ink. Such structures to pressurize ink include an electro-mechanical transducer (hereinafter, referred to as a "piezoelectric element"), a thermoelectric transducer such as a heater, an energy generating means composed of a diaphragm forming a wall surface of the ink flow path and an electrode opposed to the diaphragm, and the like.

An example of a configuration of a droplet discharging head using a piezoelectric element is described. FIG. 16 is a cross-sectional view illustrating an example of a configuration of a droplet discharging head 400. As illustrated in FIG. 16, in the droplet discharging head 400, a pressure chamber 421 is formed by a nozzle plate 410, a pressure chamber substrate 420 (a silicon (Si) substrate), and a diaphragm 430. A nozzle 411 leading into the pressure chamber 421 is provided on the nozzle plate 410, and a piezoelectric element 440 is provided on the diaphragm 430 via an adhesion layer 441. The droplet discharging head 400 is configured to discharge an ink drop from the nozzle 411 of the nozzle plate 410 by causing the piezoelectric element 440 to vibrate the diaphragm 430 thereby pressurizing the pressure chamber 421. An ink-jet recording apparatus forms an image on a recording medium such as a sheet using a recording head in which the droplet discharging heads 400 corresponding to pixels are aligned at predetermined intervals.

The piezoelectric element 440, which is a main part of the droplet discharging head 400, is formed, by means of thin-film formation, by depositing a lower electrode 442, an electro-mechanical transducer film 443, and an upper electrode 444 in this order on the adhesion layer 441. The lower electrode 442 and the upper electrode 444 are electrodes to make electrical input to the electro-mechanical transducer film 443. The electro-mechanical transducer film 443 transduces electrical input made by the lower electrode 442 and the upper electrode 444 into mechanical deformation. Specifically, lead zirconate titanate (PZT) ceramics and the like are used in the electro-mechanical transducer film 443, and these consist primarily of a plurality of metal oxides, which is generally referred to as a metal composite oxide.

A conventional method to form the piezoelectric element 440 is as follows. First, the electro-mechanical transducer film 443 is deposited on the lower electrode 442 by a well-known film formation technique, such as various vacuum film forming methods (for example, a sputtering method, a metalorganic chemical vapor deposition (MO-CVD) method using a metal organic compound), a vacuum deposition method, and an ion plating method), a sol-gel method, a hydrothermal synthesis method, an aerosol deposition (AD) method, or a metal organic decomposition (MOD) method, and the upper electrode 444 is formed on the electro-mechanical transducer film 443, and thereafter, patterning of the upper electrode 444 is performed by means of photolithography etching, and patterning of the electro-mechanical transducer film 443 and the lower electrode 442 is performed in the same manner, thereby individualizing them.

The metal composite oxide, especially PZT, is not an easy processing material for dry etching. An Si semiconductor device can be easily etched by means of reactive ion etching (RIE); however, this kind of material increases plasma energy of ion species, so special RIE with a combination of ICP plasma, ECR plasma, and helicon plasma is performed (this causes high production costs of production equipments). Furthermore, a PTZ cannot acquire a high selection ratio of etch rates to a base electrode film. In particular, non-uniformity of the etching rate is fatal to a substrate with a large area. If a hard-to-etch PZT film is arranged on a desired region only prior to etching, the above-described manufacturing process can be omitted; however, such an attempt is unsuccessful with a few exceptions. Methods of producing a PZT film individually are the hydrothermal synthesis, the vacuum deposition method, the AD method, and an ink-jet method.

Hydrothermal synthesis: PZT is selectively grown on titanium (Ti) metal. By patterning a Ti electrode before growth, a PZT film is grown only on the patterned region. To obtain a PZT film having sufficient pressure resistance by this method, a relatively-thick film with the film thickness of 5 micrometers or more is preferable (if the film thickness is less than 5 micrometers, a dielectric breakdown easily occurs in a thin film in applying an electric field, so that a thin film having a desired property cannot be obtained). Furthermore, in a case when electronic devices are formed on a Si substrate, hydrothermal synthesis is performed in strong alkaline aqueous solution, so that the protection of the Si substrate against etching becomes necessary.

Vacuum deposition: A shadow mask is used in producing an organic electroluminescent (EL) device, and patterning is performed on a luminous layer; a PZT film is formed at a substrate temperature of 500 to 600 degrees in centigrade. This is because a composite oxide has to be crystallized to emerge the piezoelectricity property, and the above range of the substrate temperature is required to obtain a crystalline film. A shadow mask is generally made of stainless steel, and the feasibility of a disposal shadow mask, which is incapable of sufficient masking due to a difference in the coefficients of thermal expansion between the Si substrate and the stainless material, is low. In particular, it is less appropriate to use a shadow mask made of stainless steel in the MO-CVD or the sputtering method in which shadow-less deposition due to gas scattering is extensive in deposited film growth.

AD method: There is known a method to form a resist pattern by photolithography prior to etching and form a PZT film on an area without resist treatment. The AD method is, similarly to the hydrothermal synthesis method described above, suitable for thick film growth and not for a thin film with the thickness of 5 micrometers or less. Furthermore, because the PZT film is deposited on a resist film, a liftoff process is performed after the deposited film partly is removed by a polishing process. The process of uniformly polishing a large area is cumbersome and complicated, and the resist film has no resistance to high temperature. Therefore, AD film is formed at room temperature, and the film is converted into a piezoelectric film by a post-annealing process.

Ink-jet method: As a prior art related to the ink-jet method in which a metal wiring pattern is formed by droplet discharging followed by drying and baking by laser light irradiation, patent documents (Japanese Patent No. 4353145, Japanese Patent No. 4232753, Japanese Patent Application Laid-open No. 2007-152250, Japanese Patent Application Laid-open No. 2007-105661) and non-patent documents (K. D. Budd, S. K. Dey, D. A. Payne, Proc. Brit. Ceram. Soc. 36,107 (1985) and A. Kumar and G. M. Whitesides, Appl. Phys. Lett. 63, 2002 (1993)) are known. Japanese Patent No. 4353145 discloses a thin-film forming apparatus having an ink-jet mechanism and a laser irradiation mechanism, and the thin-film forming apparatus includes a drawing system for discharging a droplet to a target in a workspace and is capable of performing quick and accurate positioning of a laser spot to the discharged droplet. Japanese Patent No. 4232753 discloses a technology for efficient drying/baking of a discharged droplet containing a functional material by irradiating the droplet with a laser light accurately. Japanese Patent Application Laid-open No. 2007-152250 discloses a technology to suck an evaporated component from a droplet at a suction rate corresponding to the fluidity of the droplet thereby improving the controllability of the pattern formation. Japanese Patent Application Laid-open No. 2007-105661 discloses a technology in which an open-close mechanism is provided at an irradiation port of laser light so as to close the irradiation port when no laser beam is irradiated, thereby maintaining the laser optical characteristics. K. D. Budd, S. K. Dey, D. A. Payne, Proc. Brit. Ceram. Soc. 36,107 (1985) presents a technology related to formation of a thin film made of metal composite oxide by the sol-gel method. A. Kumar and G. M. Whitesides, Appl. Phys. Lett. 63, 2002 (1993) states that alkanethiol can be formed on an Au film as a self-assembled monolayer (SAM), and a SAM pattern is transferred by a micro-contact printing method using this phenomenon to be used in a subsequent process such as etching.

However, in the conventional ink-jet method described above, a thin film is formed by directly irradiating the surface of a droplet with a laser light thereby drying/baking the droplet to result in characteristic degradation due to drying of the droplet from the surface. In an ink-jet recording apparatus using a piezoelectric element having such characteristic degradation, the quality of an image is reduced.

SUMMARY OF THE INVENTION

It is an object of the present invention to at least partially solve the problems in the conventional technology.

According to an aspect of the present invention, there is provided a thin-film forming apparatus for forming a thin film on a substrate by using an ink-jet method. The thin-film forming apparatus includes an ink applying unit that applies an ink drop for thin-film formation to a predetermined area on a surface of the substrate; at least one laser light source for heating the ink drop thereby forming a thin film; and a laser-light irradiating unit that irradiates, with a laser light from the laser light source, a first spot positioned on a back side of the predetermined area of the substrate to which the ink drop has been applied.

According to another aspect of the present invention, there is provided a thin-film forming method for forming a thin film on a substrate by using an ink-jet method. The thin-film forming method includes applying an ink drop for thin-film formation to a predetermined area on a surface of the substrate; and baking the ink drop by irradiating, with a laser light from a laser light source, a first spot positioned on a back side of the predetermined area of the substrate to which the ink drop has been applied, thereby heating the ink drop.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1A:
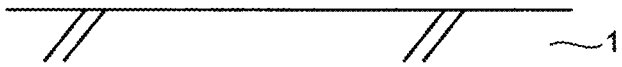
FIG. 1A is a schematic diagram showing the first step of a first example for patterning a SAM film.

An exemplary embodiment of a thin-film forming apparatus, a thin-film forming method, a piezoelectric-element forming method, a droplet discharging head, and an ink-jet recording apparatus according to the present invention is explained in detail below with reference to the accompanying drawings.

An ink-jet recording apparatus is capable of high-speed printing while minimizing the noise and has many advantages such as that the ink-jet recording apparatus has flexibility in selecting ink types and can use inexpensive plain paper. Therefore, the ink-jet recording apparatus is widely used as an image recording apparatus or image forming apparatus such as a printer, a facsimile machine, and a copier. A droplet discharging head used in the ink-jet recording apparatus includes a nozzle for discharging an ink drop, a pressurizing chamber (also referred to as an ink flow path, a pressurizing liquid chamber, a pressure chamber, a discharge chamber, or a liquid chamber, and the like.) into which the nozzle leads, and a structure to pressurize ink in the pressurizing chamber, and discharges an ink drop from the nozzle by pressurizing the ink. There are a plural types of structures to pressurize ink such as a piezo-type structure in which a diaphragm forming a wall surface of the pressurizing chamber is deformed and displaced by using a piezoelectric element thereby discharging an ink drop, a bubble-type (thermal type) structure in which bubbles are generated by means of ink film boiling using an electrothermal converter, such as a resistance heating element, placed in the pressurizing chamber thereby discharging an ink drop, and the like.

As for the piezo-type structure, there are a plural of types such as a longitudinal vibration type using deformation in a d33 direction, a lateral vibration (bend mode) type using deformation in a d31 direction, and a share mode type using shear deformation, and the like (d33 and d31 are piezoelectric charge constants). Furthermore, recently, with the advancement of semiconductor process and microelectromechanical systems (MEMS), there has been developed a thin-film actuator in which a liquid chamber and a piezoelectric element are formed directly on a Si substrate.

In the embodiment described below, a thin-film forming apparatus, a thin-film forming method, a piezoelectric-element forming method, a droplet discharging head, and an ink-jet recording apparatus are explained taking a lateral vibration (bend mode) type piezoelectric element using the deformation in the d31 direction as an example.

Formation of Piezoelectric Layer by Sol-Gel Method

In a case where a piezoelectric layer is formed with PZT, using a compound of lead acetate, zirconium alkoxide, and titanium alkoxide as a starting material (see K. D. Budd, S. K. Dey, D. A. Payne, Proc. Brit. Ceram. Soc. 36, 107 (1985)), the compound is dissolved with methoxyethanol as a common solvent to obtain homogeneous solution. This homogeneous solution is referred to as PZT precursor solution.

PZT is solid solution of lead zirconate ($PbZrO_3$) and lead titanate ($PbTiO_3$), and the PZT property varies according to a ratio between $PbZrO_3$ and $PbTiO_3$. In general, composition with the excellent piezoelectric property is obtained at a ratio between $PbZrO_3$ and $PbTiO_3$ being 53:47, which is expressed in chemical formula as $Pb(Zr0.53, Ti0.47)O_3$ and is generally denoted by PZT(53/47). The starting material, which is a compound of lead acetate, zirconium alkoxide, and titanium alkoxide, is weighed according to this chemical formula.

Metal alkoxide compound is easily hydrolyzed by moisture in the atmosphere, so an appropriate amount of stabilizer, such as acetylacetone, acetic acid, or diethanolamine, can be added into the precursor solution as a stabilizer.

Composite oxide other than PZT includes barium titanate. A compound of barium alkoxide and titanium alkoxide, being used as a starting material, is dissolved in a common solvent to produce barium titanate.

In a case that a PZT film is formed on the entire surface of the substrate which is used as a base, a coating film is formed by a solution coating method, such as spin coating, and the coating film is subjected to each of the heat treatments including solvent evaporation, pyrolysis, and crystallization. Transformation from the coating film to a crystallized film is associated with contraction in volume; therefore, to obtain a crack-free film, the concentration of the precursor has to be adjusted so as to obtain a film thickness of 100 nanometers or less in a single process.

In a case when the PZT film is used as a piezoelectric element of the droplet discharging head, the film thickness of the PZT film needs to be in the range between 1 and 2 micrometers. To obtain this film thickness by the above-described method, the process has to be repeated for more than 10 times.

In a case when a patterned piezoelectric layer is formed by the sol-gel method, PZT precursor solution is selectively applied by controlling the wettability of the substrate which is used as a base.

A phenomenon of self-arrangement on specific alkanethiol metal shown in, A. Kumar and G. M. Whitesides, Appl. Phys. Lett. 63, 2002 (1993).

Thiol forms a self-assembled monolayer (SAM) film on a platinum group metal.

Using Pt for a lower electrode, and the entire surface of the lower electrode is subjected to SAM treatment.

An alkyl group is arranged on the SAM film, so that the SAM film becomes hydrophobic.

The SAM film is subjected to patterning by the known technique of photolithography etching.

The patterned SAM film remains to keep the region hydrophobic even after the resist is removed.

A region from which SAM is removed is a surface of platinum and is hydrophilic.

Using the contrast of surface energy caused by the presence or absence of SAM, PZT precursor solution is selectively applied to the metal.

Depending on a degree of the contrast, the PZT precursor solution may be applied in a pattern even when the PZT precursor solution is applied to the entire surface by the spin coating method.

Incidentally, the PZT precursor solution can be applied by a doctor blade coating method.

Furthermore, the PZT precursor solution can be applied by a dip coating method.

Ink-jet coating method can be used to reduce the consumption of PZT precursor solution.

Letterpress can also be applied.

Figure 1B:
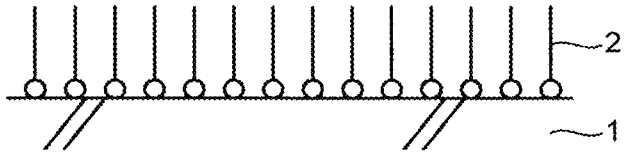
FIG. 1B is a schematic diagram showing the second step of the first example for patterning the SAM film.
Figure 1C:
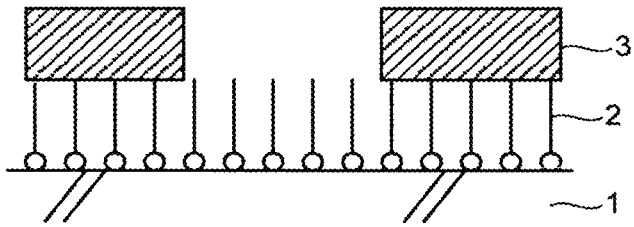
FIG. 1C is a schematic diagram showing the third step of the first example for patterning the SAM film.

Three different methods for patterning an alkanethiol SAM film are described with reference to FIGS. 1A to 1D, FIGS. 2A to 2D, and FIGS. 3A to 3D with the topmost surface of a substrate 1 illustrated in each of FIGS. 1A, 2A, and 3A from which patterning is started being described as platinum having superior reactivity with thiol.

Although alkanethiol shows a different reactivity or hydrophobicity (water repellency) depending on the length of molecular chain, molecules ranging from $C_6$ to $C_{18}$ are dissolved in a general organic solvent (such as alcohol, acetone, or toluene) (at a concentration of several mol/l). The substrate 1 is immersed in this solution, and taken out of the solution after the elapse of a predetermined period of time. Thereafter, surplus molecules are subjected to replacement washing with a solvent and drying, so that a SAM film 2 is formed on the platinum surface (FIGS. 1B, 3B).

Figure 1D:
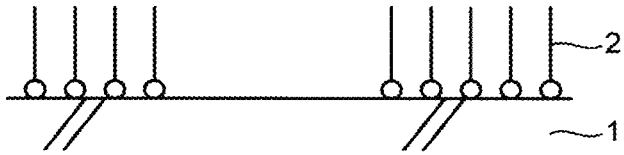
FIG. 1D is a schematic diagram showing the fourth step of the first example for patterning the SAM film.
Figure 2A:
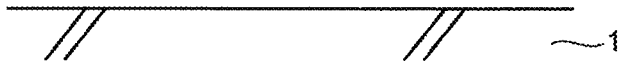
FIG. 2A is a schematic diagram showing the first step of a second example for patterning a SAM film.
Figure 2B:
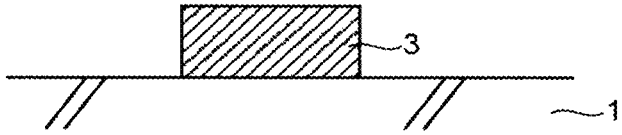
FIG. 2B is a schematic diagram showing the second step of the second example for patterning the SAM film.

In the method illustrated in FIGS. 1A to 1D, a photoresist 3 is formed in a pattern by a photolithography approach (FIG. 10), a portion of the SAM film 2 which is not masked by the photoresist 3 is removed by dry etching, the photoresist 3 used in the treatment is removed, and patterning of the SAM film 2 is completed (FIG. 1D).

Figure 2C:
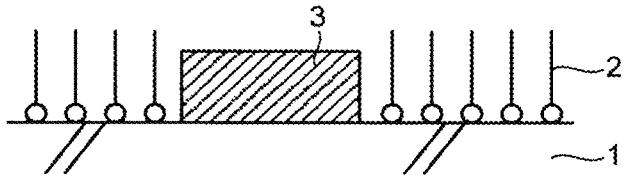
FIG. 2C is a schematic diagram showing the third step of the second example for patterning the SAM film.
Figure 2D:
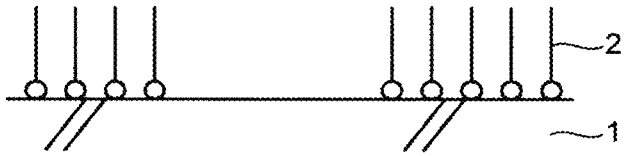
FIG. 2D is a schematic diagram showing the fourth step of the second example for patterning the SAM film.
Figure 3A:
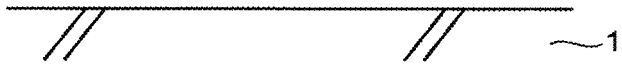
FIG. 3A is a schematic diagram showing the first step of a third example for patterning a SAM film.

In the method illustrated in FIGS. 2A to 2D, the photoresist 3 is formed first (FIG. 2B), and SAM treatment is performed afterward. In a state after the SAM treatment, the SAM film 2 is not formed on the photoresist 3 (FIG. 2C). Then, the photoresist 3 is removed, and patterning of the SAM film 2 is completed (FIG. 2D).

Figure 3B:
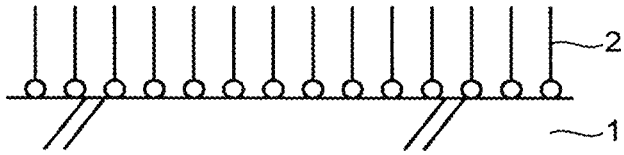
FIG. 3B is a schematic diagram showing the second step of the third example for patterning the SAM film.
Figure 3C:
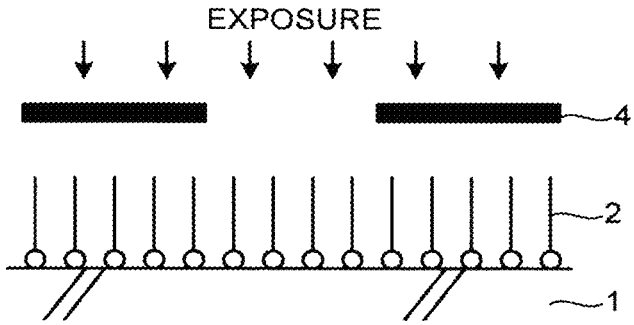
FIG. 3C is a schematic diagram showing the third step of the third example for patterning the SAM film.
Figure 3D:
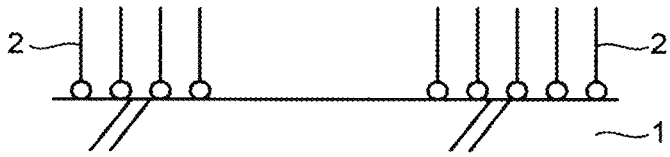
FIG. 3D is a schematic diagram showing the fourth step of the third example for patterning the SAM film.

In the method illustrated in FIGS. 3A to 3D, the SAM film 2 is formed first by the same method as that illustrated in FIGS. 1A to 1D (FIG. 3B). Then, the SAM film 2 is irradiated with ultraviolet radiation in the presence of a photomask 4 to perform exposure (FIG. 3C). Through this exposure, an unexposed portion of the SAM film 2 remains and an exposed portion of the SAM film 2 disappears (FIG. 3D).

Figure 4A:
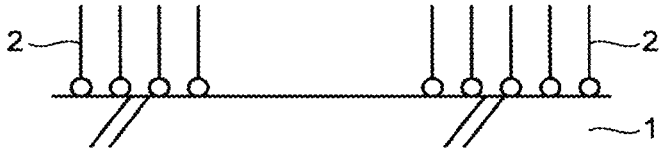
FIG. 4A is a schematic diagram showing the first step of a process for repeatedly applying a PZT precursor by using an ink-jet method.

Then, a thin film is formed by the repeated application of the PZT precursor to the substrate with the ink-jet method (FIGS. 4A to 4F). As illustrated in FIG. 4A, the surface of the SAM film 2 is a hydrophobic portion, whereas a portion of the surface of the substrate 1 which is not covered with the SAM film 2 is a hydrophilic portion.

Figure 4B:
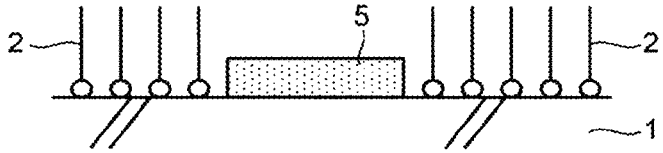
FIG. 4B is a schematic diagram showing the second step of the process for repeatedly applying the PZT precursor by using the ink-jet method.
Figure 4C:
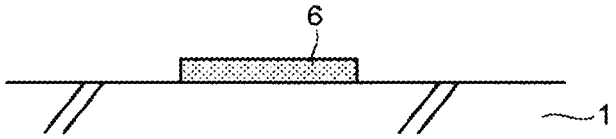
FIG. 4C is a schematic diagram showing the third step of the process for repeatedly applying the PZT precursor by using the ink-jet method.

First, a first patterned PZT precursor-coating film 5 is formed by the ink-jet method (FIG. 4B). Then, the first patterned PZT precursor-coating film 5 is subjected to heat treatments according to the conventional sol-gel process. The SAM film 2 disappears by high-temperature treatments of the precursor at 500° C. where combustion of organic materials occurs or at 700° C. where PZT crystallization occurs, and a PZT film 6 is formed by baking (FIG. 4C).

Figure 4D:
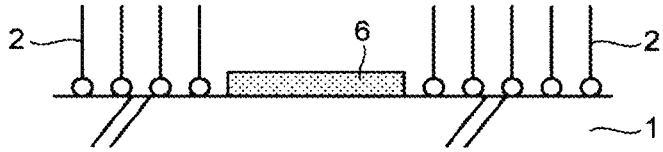
FIG. 4D is a schematic diagram showing the fourth step of the process for repeatedly applying the PZT precursor by using the ink-jet method.
Figure 4E:
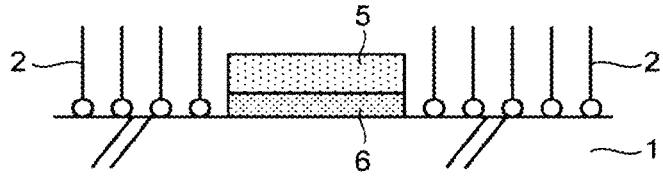
FIG. 4E is a schematic diagram showing the fifth step of the process for repeatedly applying the PZT precursor by using the ink-jet method.
Figure 4F:
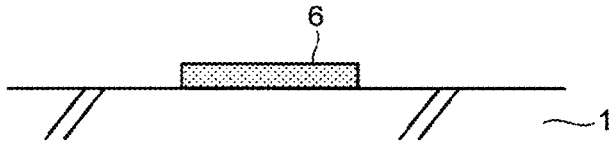
FIG. 4F is a schematic diagram showing the sixth step of the process for repeatedly applying the PZT precursor by using the ink-jet method.

The second and subsequent treatments can be simplified for the following reasons (see FIGS. 4D to 4F).

The SAM film 2 cannot be formed on a thin oxide film. Therefore, after the first treatment, there is no PZT film 6, and the SAM film 2 is formed on the exposed substrate 1 only.

In the present embodiment, the self-assembled phenomenon is used. Conventional patterning of the SAM film 2 and patterning of a functional color material (a color filter, polymer organic electroluminescence (EL), and nano-scale metal wiring) using the patterned SAM film 2 have been completed in the first SAM treatment and subsequent arrangement of the functional color material. However, in the sol-gel method, the thickness of a film formed at once is small, and hence, it is necessary to repeat the treatment for several times. Every patterned SAM film formation by the photolithography etching is a cumbersome and complicated processing. In the present embodiment, particularly, a thin oxide film on which the SAM film cannot be formed and a lower electrode as a piezoelectric element are constituent elements, and only a combination capable of forming the SAM film on the lower electrode enables the formation of a patterned SAM film.

After the first SAM treatment on the substrate 1 on which the pattern is formed (FIG. 4D), the substrate 1 is selectively coated with PZT precursor solution (FIG. 4E), followed by heat treatment (FIG. 4F).

These processes are repeated until the film thickness reaches a desired value.

Patterning by this method can form a ceramic film of up to 5 micrometers thick.

As a material used as the lower electrode, heat-resistant metal which forms a SAM film by the reaction of alkanethiol is selected. Although copper and silver form a SAM film, neither copper nor silver can be used because they change their properties by heat treatment at 500° C. or higher in the atmospheric condition. Gold that satisfies both conditions cannot be used as gold works disadvantageously to the crystallization of the PZT film. Monometal, such as platinum, rhodium, ruthenium, and iridium are also usable. Also usable are platinum-based alloy materials, such as platinum-rhodium alloy, that are alloyed with other platinum group elements.

A diaphragm arranged on the silicon substrate is several micrometers thick, and can be a silicon dioxide film, a silicon nitride film, a silicon nitride oxide film, or a lamination of these films. Furthermore, in consideration of a difference in the coefficients of thermal expansion, a ceramic film, such as an aluminum oxide film or a zirconia film, can be used as the diaphragm. These materials are all insulators.

As a common electrode when a signal is input to the piezoelectric element, the lower electrode is electrically connected to the piezoelectric element; therefore, the underlaid diaphragm is an insulator or an insulated conductor if it is a conductor.

For a silicon-based insulating film, a thermally-oxidized film or a CVD deposited film is used; a metal oxide film can be formed by the sputtering method.

Figure 16:
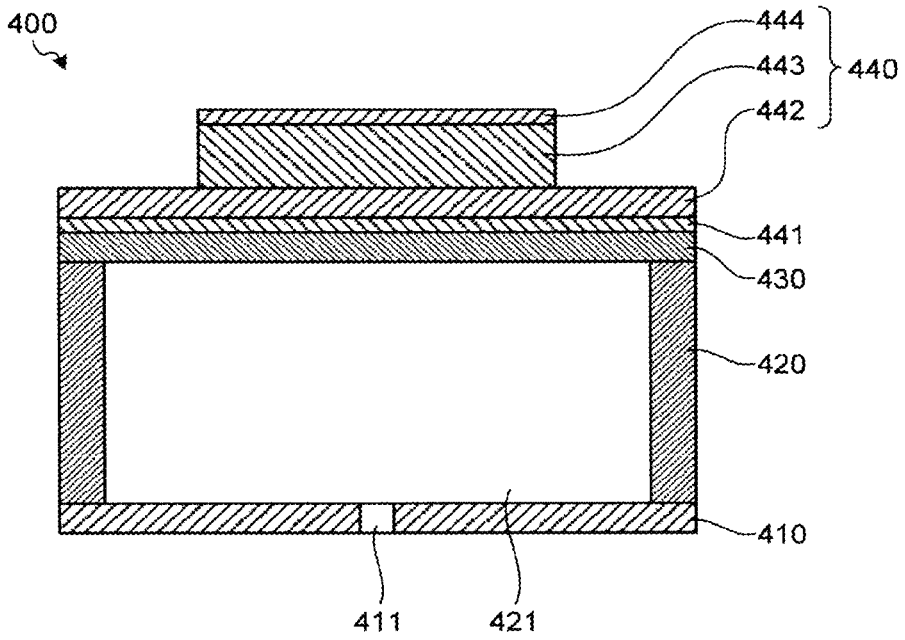
FIG. 16 is an exemplary cross-sectional view of a configuration of the droplet discharging head.

When a platinum-group lower electrode is arranged on the diaphragm, an adhesion layer to strengthen the film adhesion is required (see FIG. 16). Available materials for the adhesion layer include titanium, tantalum, titanium oxide, tantalum oxide, titanium nitride, tantalum nitride, and a laminated film made from these materials. 1

Figure 5:
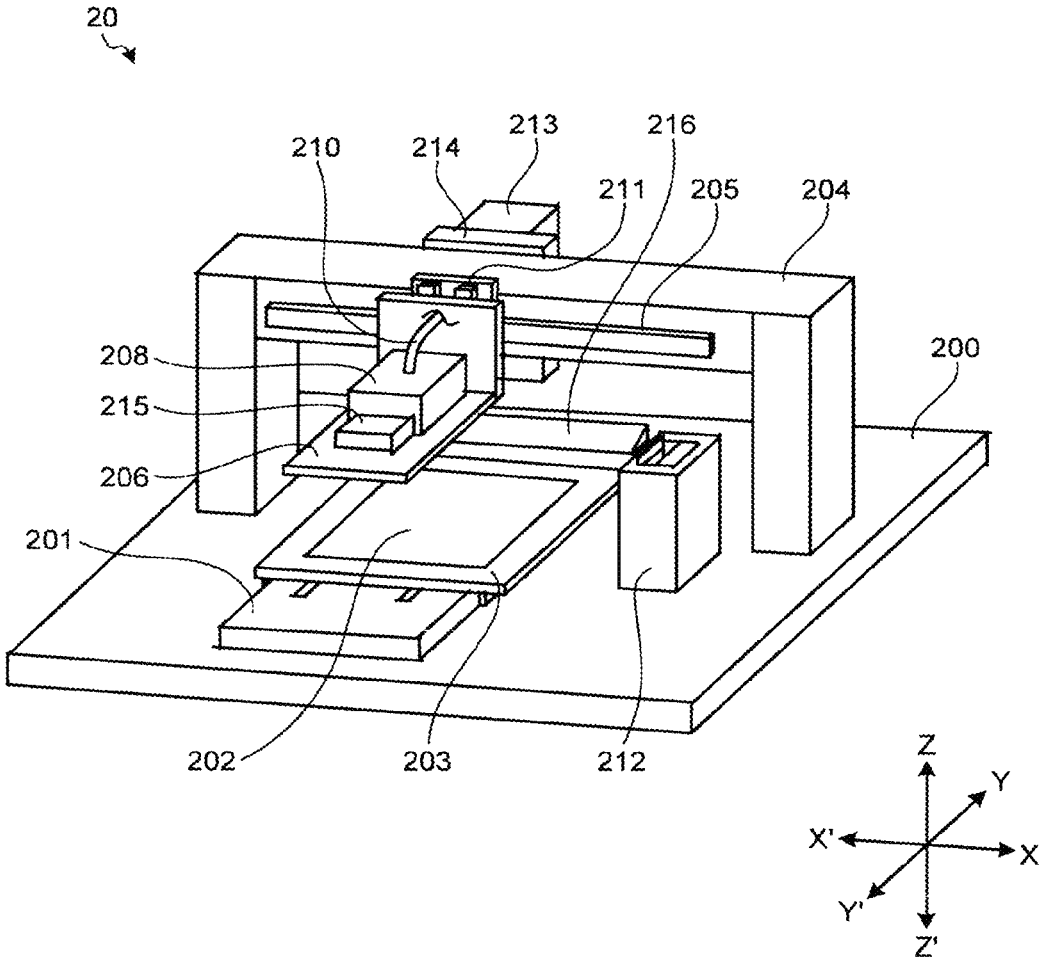
FIG. 5 is a perspective view of a thin-film forming apparatus according to a present embodiment.

A thin-film forming apparatus employing the ink-jet method described above is explained in the following. FIG. 5 is a perspective view of a thin-film forming apparatus 20 according to the present embodiment.

As illustrated in FIG. 5, in the thin-film forming apparatus 20, a Y-axis direction drive unit 201 is arranged on a board 200. A stage 203 on which a substrate 202 is mounted is driven to move in a Y-Y' direction by the Y-axis direction drive unit 201. Incidentally, the stage 203 includes a sticking unit (not shown) to pin the substrate 202 to the stage 203 by means of evacuation, electrostatic attraction, and the like. The substrate 202 is pinned to the stage 203 by the sticking unit. The stage 203 is configured to fit the substrate 202 into an opening portion thereof, thereby supporting the substrate 202, so that the back side of the substrate 202 can be irradiated with a laser light (details will be described later)

Furthermore, on the board 200, an X-axis direction supporting member 204 is arranged so as to straddle the stage 203 that is driven to move in the Y-Y' direction by the Y-axis direction drive unit 201. An X-axis direction drive unit 205 is attached to the X-axis direction supporting member 204. A headspace 206 mounted on a Z-axis direction drive unit 211 is attached to the X-axis direction drive unit 205. Therefore, the headspace 206 is driven to move in an X-X' direction and a Z-Z' direction on the stage 203. An ink-jet (IJ) head 208 for discharging an ink drop onto the substrate 202 pinned to the stage 203 and an alignment camera 215 are mounted on the headspace 206. An ink supplying pipe 210 is connected to the IJ head 208. To the IJ head 208, functional material ink (such as PZT precursor solution) is supplied from an ink tank (not shown) via the ink supplying pipe 210. This causes the IJ head 208 to discharge an ink drop, such as PZT precursor solution, onto the surface of the substrate 202 placed on the stage 203. Moreover, a head cleaning mechanism 212 for cleaning the IJ head 208 is arranged on the board 200.

The alignment camera 215 is a digital camera that includes an image sensor such as a CCD image sensor or a CMOS image sensor, and is connected to a control device such as a central processing unit (CPU) for controlling driving of the Y-axis direction drive unit 201, the X-axis direction drive unit 205, and the Z-axis direction drive unit 211, and the like. In the thin-film forming apparatus 20, an image of the surface of the substrate 202, placed on the stage 203, is taken by the alignment camera 215, and the control device controls the driving on the basis of the taken image, thereby aligning the IJ head 208 with the surface of the substrate 202. A laser light irradiating the back side of the substrate 202 is imaged, and the control device controls the driving on the basis of the image, thereby aligning a spot irradiated by the laser light with the position of an ink drop discharged onto the substrate 202 from the IJ head 208. The thin-film forming apparatus 20 can be configured to include a plurality of cameras for alignment instead of the single alignment cameras 215. That is, the thin-film forming apparatus 20 can be configured such that alignment of the IJ head 208 and alignment of a laser light with the position of an ink drop are performed separately by using different cameras. For example, the alignment camera 215 for imaging a laser light can be arranged on the side of the stage 203 so as to take an image from the back side of the substrate 202. In a configuration in which the alignment camera 215 is arranged above the substrate 202, the back side of the substrate 202 is subject to irradiation of a laser light, so that alignment by detection of heat using an infrared camera or the like is performed.

On the opposite side of the headspace 206 in the Y-Y' direction with respect to the X-axis direction supporting member 204, a laser head 213 and a Z-axis direction laser drive unit 214 for driving the laser head 213 in conjunction with the Z-axis direction drive unit 211 are arranged. The Z-axis direction laser drive unit 214 is attached to the X-axis direction drive unit 205, and shares movement in the X-X' direction with the headspace 206. Therefore, the movement of the headspace 206 and the movement of the laser head 213 in both the Y-Y' direction and the X-X' direction with respect to the substrate 202 placed on the stage 203 are synchronized with each other. Beneath the laser head 213 driven to move in the X-X' direction, a reflector 216 is arranged on the board 200. The reflector 216 reflects a laser light emitted from the laser head 213 to guide the laser light to a point beneath the substrate 202.

Figure 6:
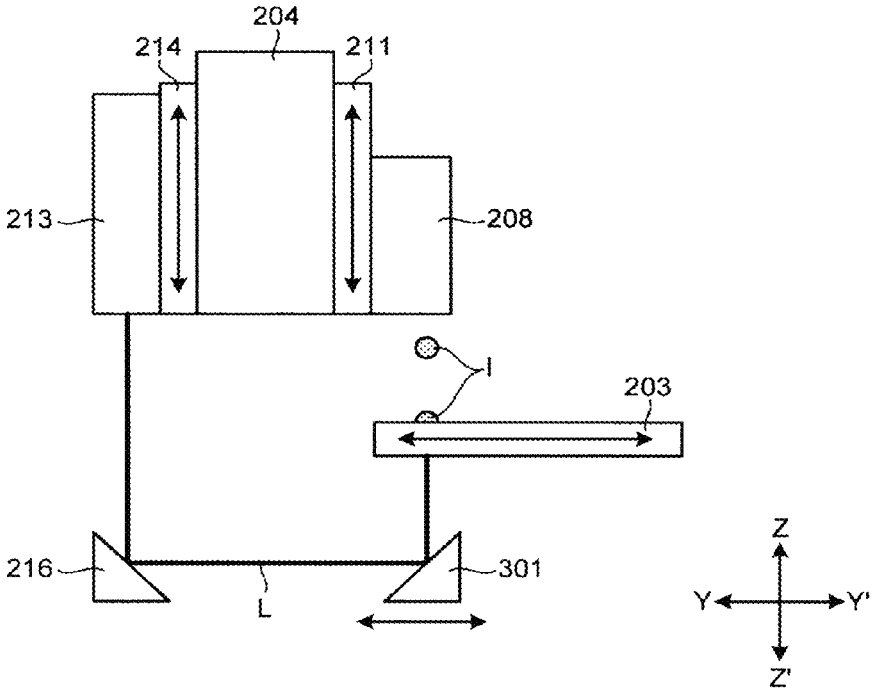
FIG. 6 is a conceptual diagram for explaining a laser irradiation mechanism in the thin-film forming apparatus.

FIG. 6 is a conceptual diagram for explaining a laser irradiation mechanism of the thin-film forming apparatus 20. As illustrated in FIG. 6, the laser head 213 emits a laser light L downward. The emitted laser light L is reflected by the reflector 216 to be approximately parallel to the substrate 202, and is guided to the point under the stage 203, i.e., beneath the substrate 202. Under the stage 203, a reflector 301 driven to move in the Y-Y' direction by a driving mechanism (not shown) controlled by the above-described control device is arranged. The reflector 301 reflects the laser light L guided to a point beneath the substrate 202 so as to irradiate the back side of the substrate 202. Under the control of the control device, the reflector 301 is driven to move in the Y-Y' direction, thereby enabling arbitrary control of the timing to irradiate the back side of the substrate 202 with the laser light L. That is, the timing to dry/back an ink drop I, which has been discharged from the IJ head 208 and adhered to the surface of the substrate 202, by the irradiation of the laser light L from the back side of the substrate 202 can be arbitrarily controlled.

At this time, although the laser head 213 can be a multi-channel type or a single-channel type, the multi-channel type is preferred to the single-channel type. The wavelength of the laser is preferably within a range of infrared wavelengths or ultraviolet wavelengths, and, more preferably, is a wavelength having a high coefficient of absorption by the substrate 202 or a film formed on the substrate 202.

Modified Example of Laser Irradiation Mechanism

Figure 7:
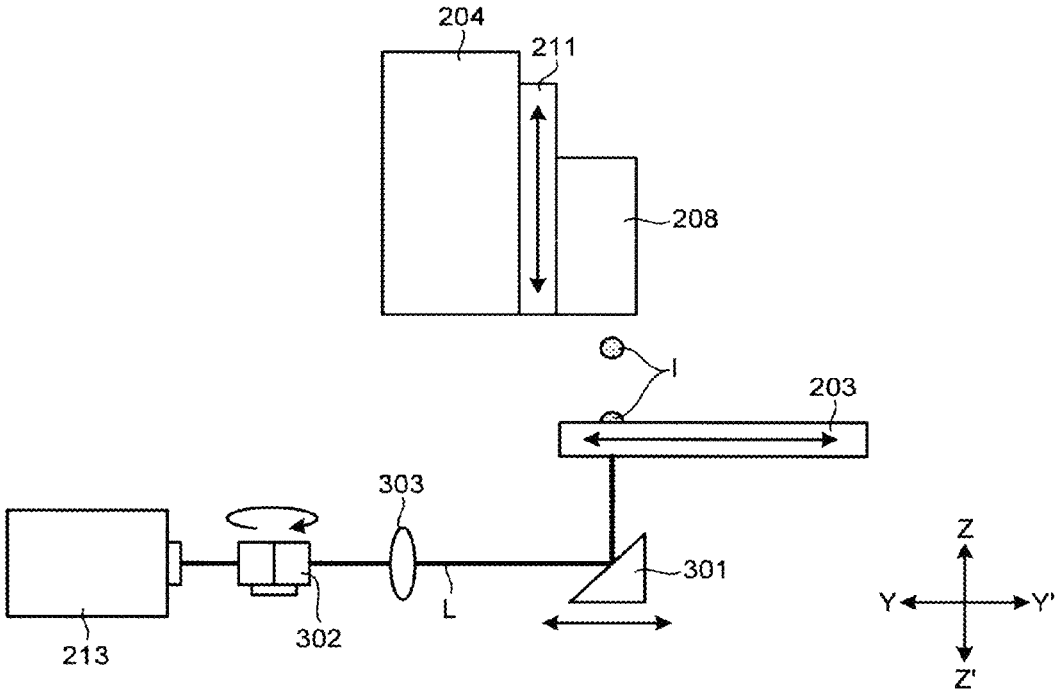
FIG. 7 is a conceptual diagram for explaining an example of a modified laser irradiation mechanism.

In the laser irradiation mechanism according to the embodiment described above, any mechanism can be used as long as the mechanism can irradiate a laser light L to the back side of the substrate 202. FIG. 7 is a conceptual diagram for explaining an example of the modified laser irradiation mechanism. As illustrated in FIG. 7, the laser head 213 is fixed in a different location from the location of the IJ head 208, and the laser head 213 does not have to move in conjunction with the IJ head 208. A laser light L emitted from the laser head 213 is scanned by a polygon mirror 302 and then shaped into a parallel light by a lens 303. Thereafter, the laser light L is reflected by the reflector 301 to irradiate the back side of the substrate 202. Also in such a modified example, the laser light L is still irradiated to the back side of the substrate 202, and an equal effect as in the example illustrated in FIG. 6 can be obtained.

Next, a thin-film formation process using the thin-film forming apparatus 20 is explained. In the thin-film formation process, a thermally-oxidized film (of 1 micrometer in film thickness) has been formed on a silicon wafer, and, as an adhesion layer, a titanium film (of 50 nanometers in film thickness) has been formed by sputtering on the thermally-oxidized film. Then, as a lower electrode, a platinum film (of 200 nanometers in film thickness) has been formed on the titanium film by sputtering. Thereafter, the substrate has been immersed in solution of alkanethiol, for which $CH_3(CH_2)_6$—SH is used, at a concentration of 0.01 mol/l (isopropyl alcohol is used as a solvent), and has been subjected to SAM treatment. Thereafter, the substrate is, after being washed by isopropyl alcohol and dried, subjected to patterning.

Figure 8:
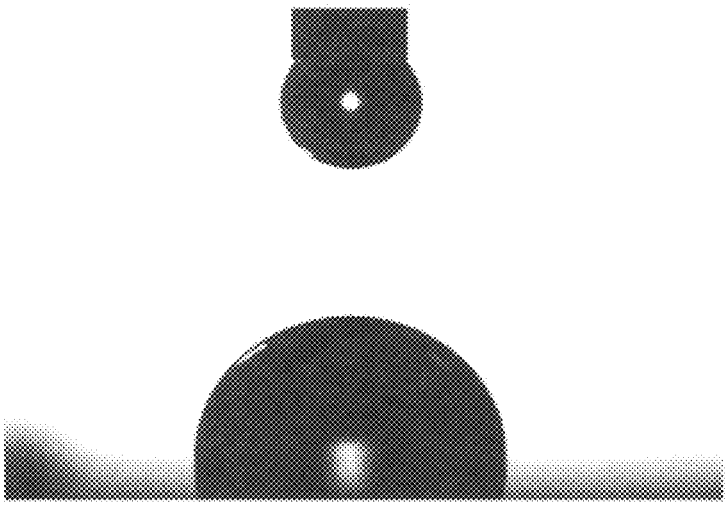
FIG. 8 is a photograph showing the measurement of a water contact angle on a SAM-film formed portion.

The hydrophobicity after the SAM treatment has been evaluated by the measurement of a contact angle, and a water contact angle on the SAM film has been measured as 92.2° (see FIG. 8). In contrast, a water contact angle on the platinum-sputtered film before the SAM treatment has been measured as 5° or less (fully wet) to show that the SAM film treatment has been performed.

Figure 9:
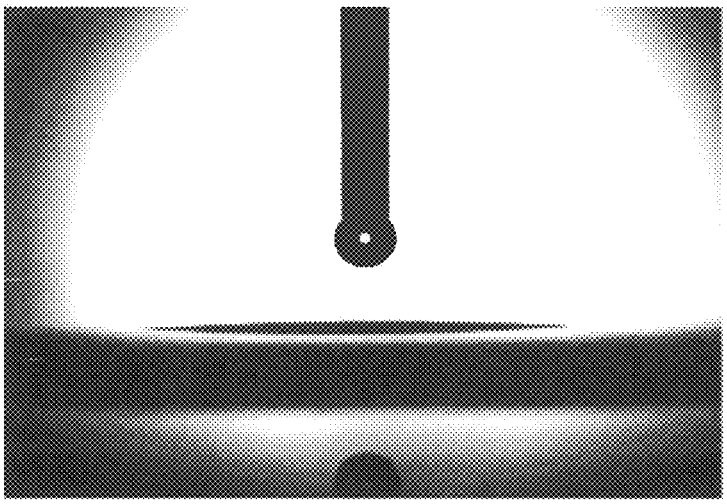
FIG. 9 is a photograph showing the measurement of a water contact angle on a SAM-film removed portion.

A thin film has been formed by applying a photoresist (TSMR8800) manufactured by TOKYO OHKA KOGYO Co., Ltd. by the spin coating method, and a resist pattern has been formed by conventional photolithography approach, followed by the oxygen plasma treatment to remove an exposed portion of the SAM film. The residual resist after the treatment has been dissolved and removed by acetone, and a similar evaluation of a contact angle as above has been carried out to find that a contact angle at the removed portion has been measured as 5° or less (fully wet, see FIG. 9), and a contact angle at a portion covered with the resist has been measured as 92.4° to confirm that the SAM film has been patterned in the portion.

As another patterning method, a resist pattern has been formed by a similar resist work in advance, and a similar SAM treatment has been performed. Thereafter, the resist has been removed by acetone, and a contact angle has been measured. A contact angle on a portion of the platinum film covered with the resist has been measured as 5° or less (fully wet), and a contact angle on the other portion has been measured as 92.0° to confirm that the SAM film has been patterned there.

As still another patterning method, irradiation of an ultraviolet light on a film with a shadow mask has been performed. The ultraviolet light used in the irradiation is a vacuum ultraviolet ray with a wavelength of 176 nanometers generated by an excimer lamp, and the film with the shadow mask has been irradiated with the vacuum ultraviolet ray for ten minutes. A contact angle on the irradiated portion has been measured as 5° or less (fully wet), and a contact angle on the unirradiated portion has been measured as 92.2° to confirm that the SAM film has been patterned.

As a piezoelectric layer, a PZT(53/47) film is formed. In the synthesis of precursor coating liquid, lead acetate trihydrate, titanium isopropoxide, and zirconium isopropoxide have been used as starting materials. Water of crystallization in lead acetate has been dissolved in methoxyethanol, and then dehydrated. Surplus of lead by 10 mole percent as compared to stoichiometric composition has been set. This is to prevent in the reduction of the crystalline property due to the so-called "lead volatilization" in the heat treatment.

Titanium isopropoxide and zirconium isopropoxide have been dissolved in methoxyethanol thereby accelerating alcohol exchange reaction and esterification reaction, and mixed with methoxyethanol solution in which the above-described lead acetate has been dissolved, thereby synthesizing PZT precursor solution. The PZT concentration has been set as 0.1 mol/l.

The film thickness obtained in one sol-gel film formation is preferably about 100 nanometers, and the precursor concentration is optimized on the basis of the relationship between an area of the film formed and an applied quantity of the precursor (therefore, it is not limited to 0.1 mol/l).

This precursor solution has been applied to the patterned SAM film by the ink-jet method (see FIG. 4B). By the ink-jet method, a droplet has been discharged to a hydrophilic portion only and not to the SAM film, i.e., a coating film has been formed on the hydrophilic portion only by the contrast of the contact angles. In this film coating, the substrate has been heated by laser irradiation to the back side of the substrate, and patterned precursor ink has been dried and crystallized (baked) (see FIG. 4C).

Droplets have been repeatedly discharged to the same site by the ink-jet method, and laser irradiation to the site has been repeated to overglaze the SAM film (see FIGS. 4D to 4F).

The above process has been repeated for 15 times, and a 500-nanometer-thick film has been obtained. There has been no defect such as crack in the film thus produced. Furt performing selective application of PZT precursor and laser irradiation for 15 times to perform crystallization treatment. There has been no defect, such as crack, in the film. The thickness of the film reached 1000 nanometers.

Figure 10:
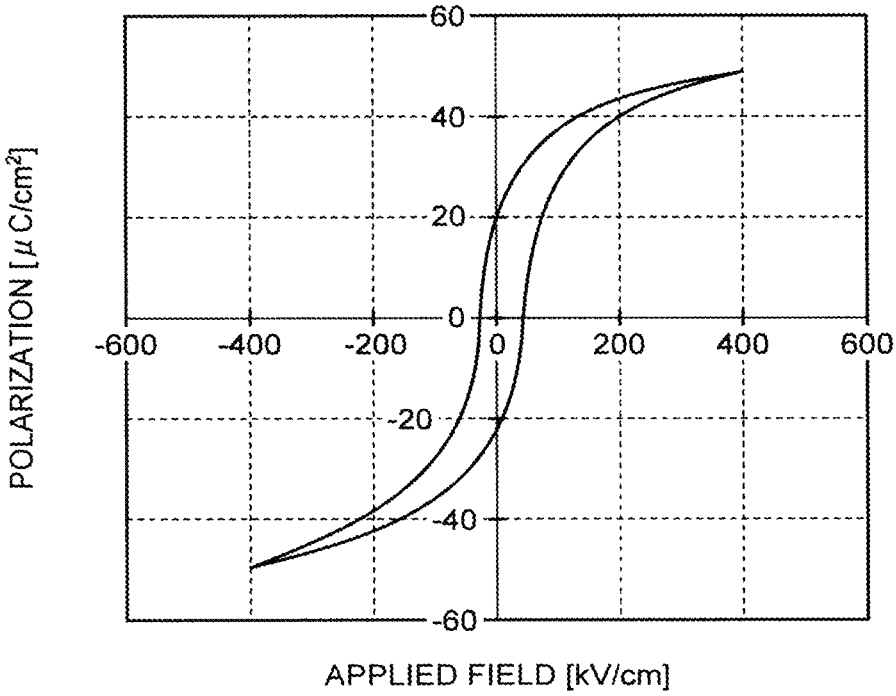
FIG. 10 is a graph showing a P-E hysteresis curve of a piezoelectric element produced by thin-film formation according to the present embodiment.

An upper electrode (platinum) film has been formed on the patterned film, and an electric property and an electro-mechanical transduction capacity have been evaluated. FIG. 10 is a graph showing a polarization against an applied field (P-E) hysteresis curve of the piezoelectric element produced by the thin-film formation process according to the present embodiment. The graph shows that a relative permittivity of the film is 1220, a dielectric loss is 0.02, residual polarization is 19.3 $\mu C/cm^2$, a coercive electric field is 36.5 kV/cm, and the film has equal characteristics as those of an ordinary ceramic sintered compact.

The electro-mechanical transduction capacity has been calculated based on the comparison between the deformed amount due to the application of an electric field measured by using a laser Doppler vibrometer and a computer simulation. The piezoelectric constant d31 thus estimated is −120 pm/V, which is similar to the value for the ceramic sintered compact. This value indicates that the piezoelectric material obtained by the method described above can be used as a part of a droplet discharging head in designing the droplet discharging head.

Incidentally, an electrode film can be formed in a similar manner as the piezoelectric layer, i.e., dissolving platinum or metal oxide such as $SrRuO_3$ or $LaNiO_3$ in a solvent, and the obtained solution is applied by the ink-jet method and subjected to drying/baking by the laser irradiation.

Figure 11:
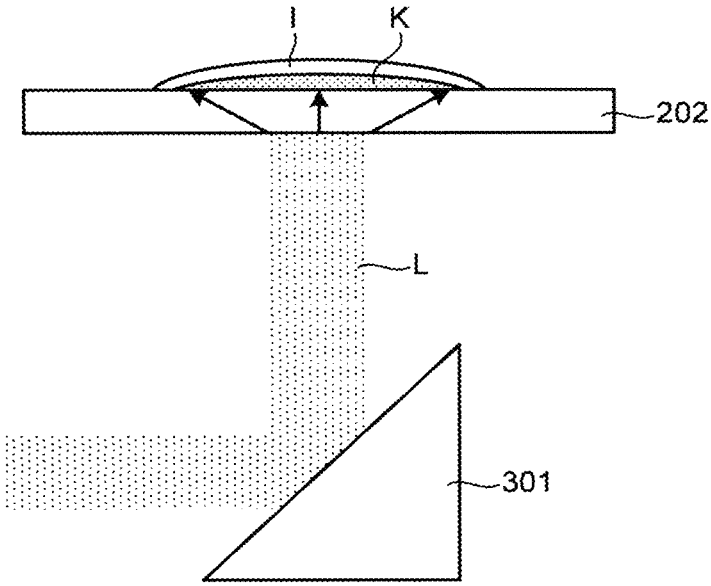
FIG. 11 is a cross-sectional view for schematically illustrating film formation by patterning an ink drop on a substrate.

FIG. 11 is a cross-sectional view for explaining the film formation by patterning an ink drop I on the substrate 202. As illustrated in FIG. 11, the back side of the substrate 202 on which the ink drop I has been patterned is irradiated with a laser light L, and heat generated by the irradiation is conducted through the substrate 202 and applied to the ink drop I adhered to the surface of the substrate 202. In this case, the ink drop I is heated with an area determined by a spot diameter of the laser light L, so that the spot diameter of the laser light L has to be adjusted in accordance with the accuracy of the pattern to be formed. By the application of heat to the ink drop I, a crystallized site K spreads from a portion being in contact with the surface of the substrate 202, with the center being irradiated by the laser light L, towards the surface of the ink drop I. Therefore, defect, such as a crack, is less likely to be caused as compared with a case where the crystallized site K spreads from the surface to the inside of the ink drop I.

Figure 12:
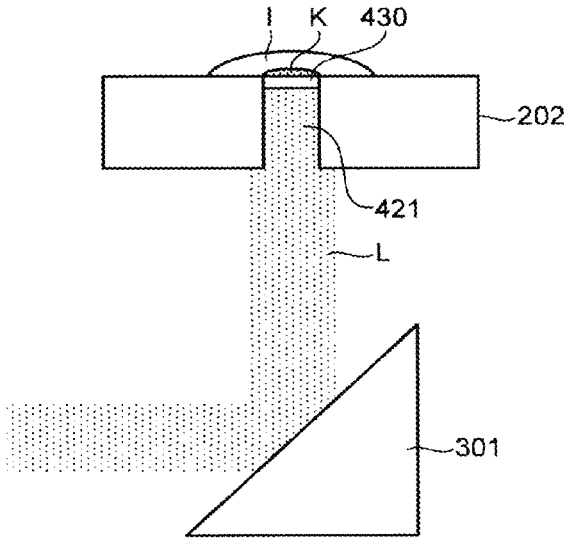
FIG. 12 is a cross-sectional view for schematically illustrating film formation by patterning an ink drop on a substrate having a structure on the back side thereof.

FIG. 12 is a cross-sectional view for explaining the film formation by patterning an ink drop I on the substrate 202 having a structure on the back side thereof. As illustrated in FIG. 12, in a case where a pressure chamber 421 and a diaphragm 430 are formed from the back side of the substrate 202, heat is effectively conducted to a portion of the ink drop I on the diaphragm 430 by a difference between heat conduction from the back side of the substrate 202 to the surface through the inside and heat conduction to the surface through the diaphragm 430, and therefore, a thin film covering the piezoelectric element can be formed easily and accurately.

Figure 13:
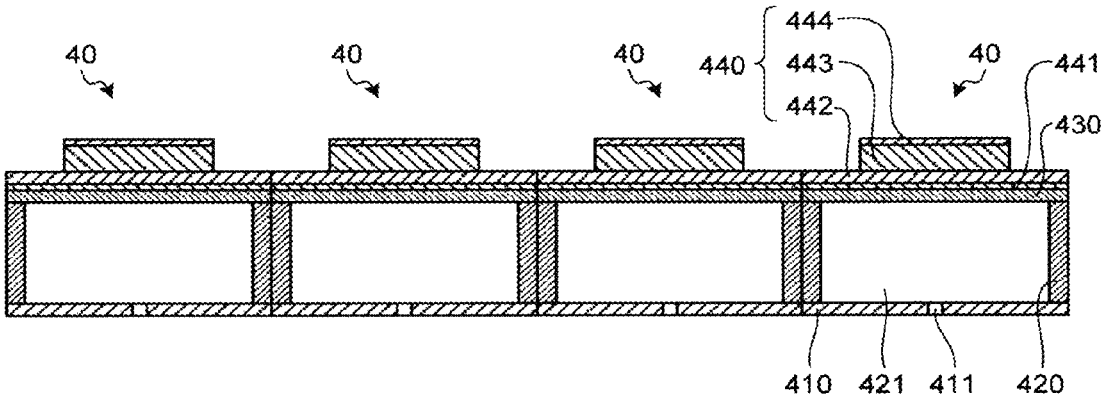
FIG. 13 is a cross-sectional view showing a configuration of a droplet discharging head formed by the thin-film formation according to the present embodiment.

FIG. 13 is a cross-sectional view showing a configuration of a droplet discharging head 40 formed by the thin-film formation according to the present embodiment. As illustrated in FIG. 13, a plurality of droplet discharging heads 40 are arranged at predetermined intervals so that each droplet discharging head 40 discharges an ink drop corresponding to one pixel. In the present embodiment, a piezoelectric element 440 illustrated in FIG. 13 (and having the same performance as bulk ceramics) can be formed by a simple production process, and the droplet discharging head 40 can be formed by subsequent etching removal from the back side for forming the pressure chamber 421 and connection with a nozzle plate 410 having a nozzle 411. Incidentally, in FIG. 13, description of a supply unit for supplying ink liquid to the pressure chamber 421, a flow path, and fluid resistance is omitted.

Figure 14:
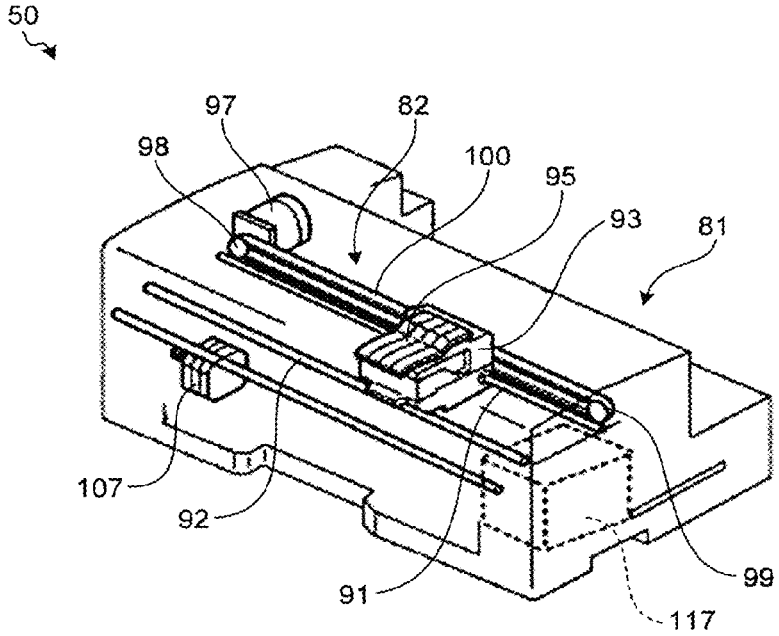
FIG. 14 is an explanatory perspective view of an ink-jet recording apparatus according to the present embodiment.
Figure 15:
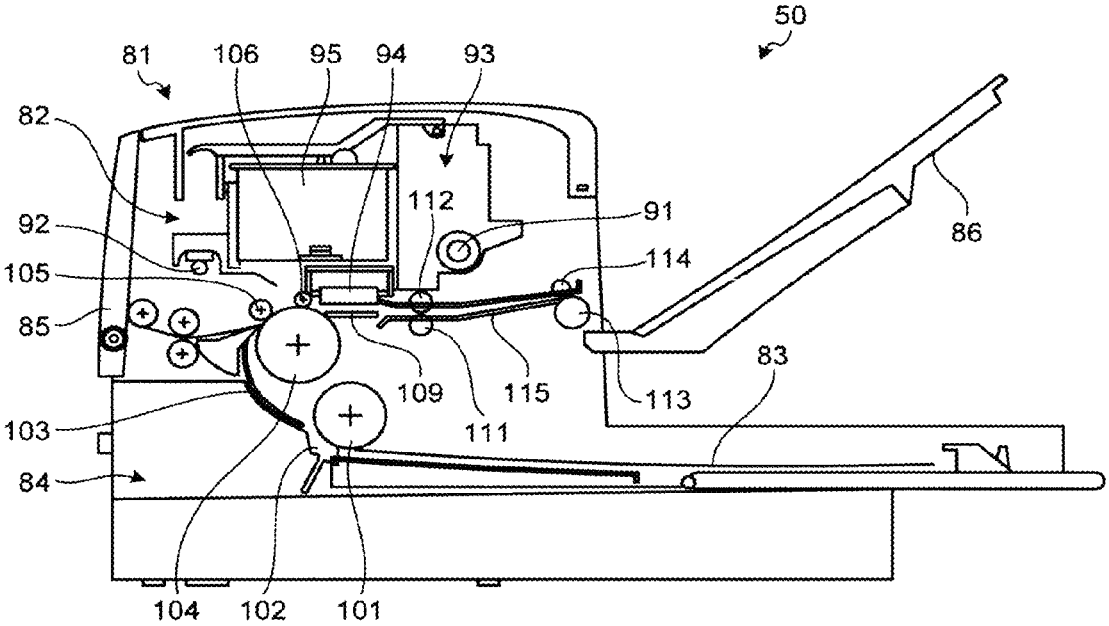
FIG. 15 is an illustrative side view of a mechanical part of the ink-jet recording apparatus according to the present embodiment.

Next, an explanation is given of an example of an ink-jet recording apparatus, equipped with a plurality of the droplet discharging heads 40, with reference to FIGS. 14 and 15. FIG. 14 is an explanatory perspective view of an ink-jet recording apparatus according to the present embodiment. FIG. 15 is an explanatory side view of a mechanical part of the ink-jet recording apparatus according to the present embodiment.

As illustrated in FIGS. 14 and 15, an ink-jet recording apparatus 50 includes, in a main body 81 thereof, a printing mechanical unit 82 including a carriage 93 which is movable in a main scanning direction, a recording head 94 which is mounted on the carriage 93 and which includes the droplet discharging heads formed by one of the thin-film formation processes described above, and an ink cartridge 95 for supplying ink to the recording head 94, and the like. At a lower part of the main body 81, a paper cassette 84 (or a paper feed tray) and a manual feed tray 85 are mounted. The paper cassette 84 can include therein a number of sheets 83. The paper cassette 84 is removably mounted in the main body 81, and can be inserted into and removed from the main body 81 on the front side. The manual feed tray 85 is used for feeding a sheet 83 manually, and can be opened and folded back. A sheet 83 fed by the paper cassette 84 or the manual feed tray 85 is conveyed to the printing mechanical unit 82, and a required image is recorded on the sheet 83 by the printing mechanical unit 82, and thereafter, the sheet 83 is discharged onto a discharge tray 86 mounted on the rear side of the main body 81.

The printing mechanical unit 82 holds the carriage 93 such that the carriage 93 can slide in the main scanning direction by setting the carriage 93 on a primary guide rod 91 and a secondary guide rod 92, which are guide members laterally bridging between right and left side plates (not shown). On the carriage 93, the recording head 94 that includes the droplet discharging heads for discharging, respectively, yellow (Y), cyan (C), magenta (M), and black (Bk) ink (YCMK ink), which are formed by the thin-film formation process described above, is mounted so that a plurality of ink nozzles are arranged in a direction perpendicular to the main scanning direction and a ink-drop discharging direction of the ink nozzles is set to downward. Furthermore, on the carriage 93, the YCMK ink cartridges 95 for supplying ink to the recording head 94 are replaceably mounted.

Each of the ink cartridges 95 has an atmospheric opening open to the atmosphere at the upper portion thereof, a supply port for supplying ink to an ink-jet head at the lower portion thereof, and a porous body filled with ink at the inner portion thereof, and ink supplied to the recording head 94 is kept under slightly negative pressure by a capillary force of the porous body. Although the color heads of a plurality of colors necessary for color printing are used for the recording head 94 in this example, a single head having a plurality of nozzles for discharging color ink drops of a plurality of colors necessary for color printing can be used.

Here, the rear side (the downstream side in a sheet conveying direction) of the carriage 93 is slidably fitted to the primary guide rod 91, and the front side (the upstream side in the sheet conveying direction) of the carriage 93 is slidably put on the secondary guide rod 92. Then, to move the carriage 93 in the main scanning direction, a timing belt 100 is extended between a drive pulley 98 driven to rotate by a main-scanning motor 97 and a driven pulley 99, and the timing belt 100 is fixed to the carriage 93, so that the carriage 93 is driven to reciprocate by the rotation of the main-scanning motor 97 in the forward and backward directions.

On the other hand, to convey a sheet 83 set in the paper cassette 84 to the lower side of the recording head 94, there are provided a paper feeding roller 101 and a friction pad 102 for picking up a sheet 83 from the paper cassette 84 and feeding the sheet 83 one by one, a guide member 103 for guiding the sheet 83, a conveying roller 104 for reversing the fed sheet 83 and conveying the reversed sheet 83, and a leading-end roller 106 for controlling an angle of the sheet 83 fed out from between the conveying roller 104 and a conveying roller 105 pressed against the peripheral surface of the conveying roller 104. The conveying roller 104 is driven to rotate by a sub-scanning motor 107 via a gear train.

Furthermore, there is provided a print receiving member 109 which is a sheet guide member for guiding the sheet 83 fed out from the conveying roller 104 at the lower side of the recording head 94 in accordance with a moving range of the carriage 93 in the main scanning direction. On the downstream side of this print receiving member 109 in the sheet conveying direction, there are provided a conveying roller 111 driven to rotate to feed the sheet 83 to a discharging direction, a spur 112, discharging rollers 113 and 114 for discharging the sheet 83 onto the discharge tray 86, and guide members 115 and 116 which form a discharge path.

In recording, the recording head 94 is driven in accordance with an image signal while moving the carriage 93, thereby discharging an ink drop onto the sheet 83 being at a stop, and an image for one line is recorded on the sheet 83, and then, after the sheet 83 is conveyed for a predetermined distance, recording of an image for the next line is performed. Upon receipt of a recording end signal or a signal indicating that a trailing end of the sheet 83 has reached a recording area, the recording operation is terminated, and the sheet 83 is discharged.

Furthermore, in the position out of the recording area on the side of the right end of the carriage 93 in the moving direction, a restoring device 117 for restoring a discharge error of the recording head 94 is arranged. The restoring device 117 has a capping unit, a suction unit, and a cleaning unit. While being on standby for printing, the carriage 93 is moved to the side of the restoring device 117, and the recording head 94 is capped by the capping unit and the nozzle portion is kept in a wet condition, thereby preventing a discharge error due to drying of ink. Furthermore, by discharging ink which is not related to recording, for example, in the middle of the recording, the ink viscosity of all nozzles is kept constant, and the stable discharging performance is maintained.

In the event of a discharge error, the discharge error is restored in such a manner that the nozzle of the recording head 94 is sealed with the capping unit, and ink as well as air bubbles and the like are suctioned through a tube by the suction unit, and then, ink, dust, and the like. adhering to the nozzle surface is removed by the cleaning unit. Incidentally, the suctioned ink is discharged into a waste ink reservoir (not shown) arranged at the lower portion of the main body, and absorbed and kept by an ink absorber in the waste ink reservoir.

The above-described ink-jet recording apparatus 50 is equipped with the recording head 94 using the droplet discharging heads formed by the thin-film formation process described above, so the ink-jet recording apparatus 50 has no ink-drop discharge error due to a diaphragm driving error and achieves a stable ink-drop discharge characteristic, and therefore, the quality of an image is improved.

Modification

Figure 17:
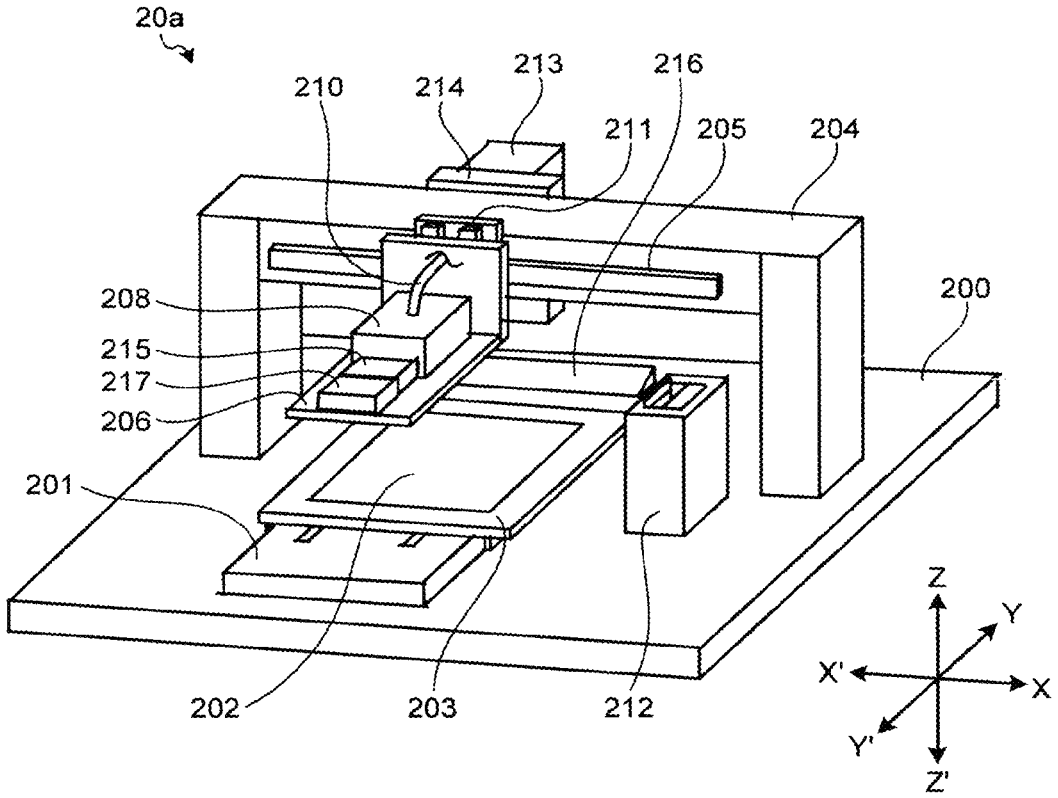
FIG. 17 is a perspective view of a thin-film forming apparatus according to a modified embodiment of the present invention.

A modification of the thin-film forming apparatus is explained. FIG. 17 is a perspective view of a thin-film forming apparatus 20*a* according to the modification. Incidentally, the same elements as those described above are assigned the same reference numerals, and the description of the elements is omitted.

As illustrated in FIG. 17, a second laser head 217 is mounted on the headspace 206 of the thin-film forming apparatus 20*a*. The second laser head 217 emits a laser light to the surface of the substrate 202 placed on the stage 203, thereby heating an ink drop discharged onto the substrate 202. As the second laser head 217 is arranged on the headspace 206, the second laser head 217 moves in conjunction with the IJ head 208 in the Y-Y' direction and the X-X' direction with respect to the substrate 202 placed on the stage 203. That is, the position scanned by a laser light emitted from the second laser head 217 is associated with the position to which an ink drop is discharged from the IJ head 208. Incidentally, the second laser head 217 does not have to be arranged on the headspace 206 insofar as the position scanned by a laser light emitted from the second laser head 217 is associated with the position to which an ink drop is discharged from the IJ head 208.

Figure 18:
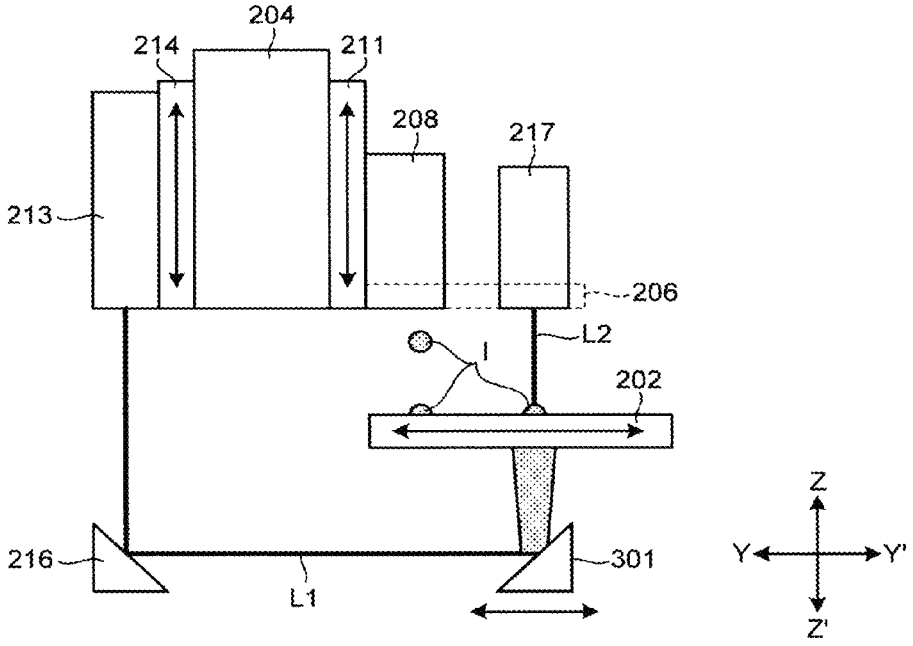
FIG. 18 is a conceptual diagram for explaining a laser irradiation mechanism of the thin-film forming apparatus according to the modified embodiment of the present invention.

FIG. 18 is a conceptual diagram for explaining a laser irradiation mechanism of the thin-film forming apparatus 20*a* according to the modification. As illustrated in FIG. 18, the laser head 213 emits a laser light L1 downward. The emitted laser light L1 is reflected by the reflector 216 to be made approximately parallel to the substrate 202, and is guided to a place under the stage 203, i.e., below the substrate 202. Under the stage 203, the reflector 301 driven to move in the Y-Y' direction by the drive mechanism (not shown) controlled by the above-described control device is arranged. The reflector 301 reflects the laser light L1 guided to a place below the substrate 202 so as to irradiate the back side of the substrate 202 with the laser light L1.

At this time, the laser light L1 is used for irradiation in a state where the diameter of the laser light L1 is larger than a targeted pattern (pattern of an ink drop I), i.e., in a state where the laser light L1 is not fully focused (a defocused state). This defocused state is realized by adjusting the reflecting surface of the reflector 301 and an optical lens attached to the first laser head 213, and the like. in advance.

Under the control of the control device, the reflector 301 is driven to move in the Y-Y' direction, thereby arbitrarily controlling the timing to irradiate the back side of the substrate 202 with the laser light L1. Namely, the timing to dry/bake an ink drop I, which has been discharged from the IJ head 208 and adhered to the surface of the substrate 202, by irradiation of the laser light L1 from the back side of the substrate 202 can be arbitrarily controlled.

At this time, although the laser head 213 can be a multi-channel type or a single-channel type, the multi-channel type is preferred to the single-channel type. The wavelength of the laser is preferably within a range of infrared wavelengths or ultraviolet wavelengths, and, more preferably, is a wavelength having a high absorption coefficient to be absorbed by the substrate 202 or a film formed on the substrate 202.

Then, a second laser light L2 emitted from the second laser head 217 is irradiated to the ink drop I adhered to the surface of the substrate 202 simultaneously or at a different time with the laser light L1 emitted from the laser head 213. The second laser light L2 is irradiated in accordance with the intended pattern such that the shape of rays of the second laser light L2 is adjusted to conform to the pattern of the ink drop I or the second laser light L2 is scanned in accordance with the pattern of the ink drop I and the like.

In this manner, the laser light L1 in the defocused state, i.e., the laser light L1 of which the irradiated area is larger than the pattern of the ink drop I to be dried/baked is irradiated to the back side of the substrate 202, and the second laser light L2 is irradiated in accordance with the pattern of the ink drop I, and, as a result, energy can be constantly supplied to the pattern and the surrounding area, and thermal dissipation of the substrate 202 due to heat conduction around the pattern, and the like can be suppressed, thereby a stable heat supply is accomplished. Furthermore, a crack or ablation due to excessive laser irradiation can be suppressed, and a smooth, damage-free drying/baking process can be realized.

Modified Example of Laser Irradiation Mechanism

Figure 19:
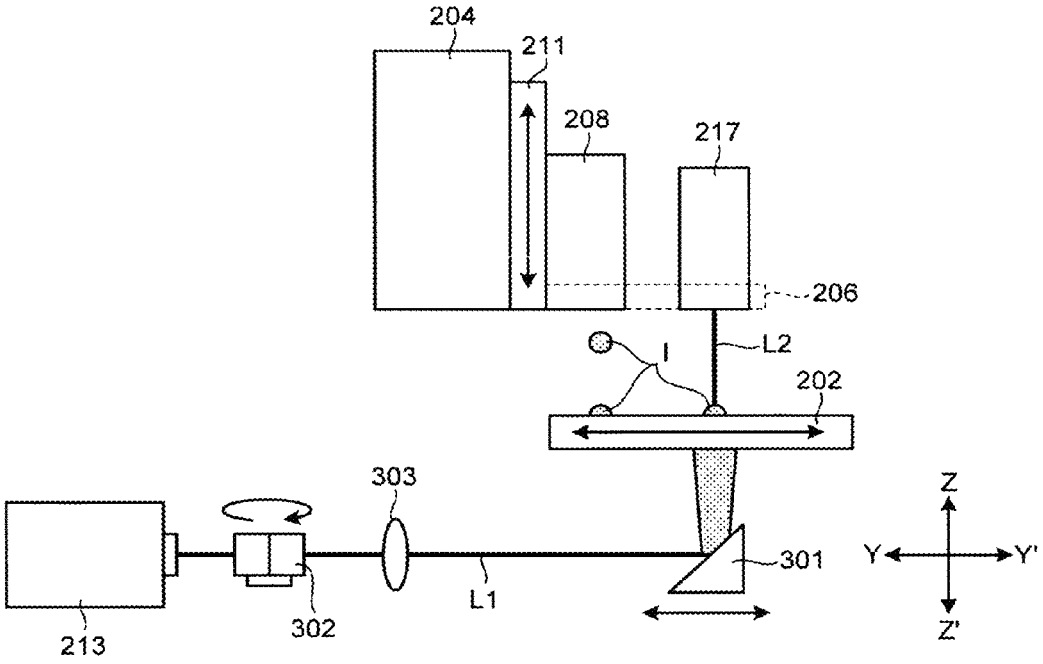
FIG. 19 is a conceptual diagram for explaining an example of a modified laser irradiation mechanism.

Incidentally, as the above-described laser irradiation mechanism in the modification, any mechanism can be used insofar as the mechanism can irradiate the back side of the substrate 202 with a laser light L1. FIG. 19 is a conceptual diagram for explaining an example of the modified laser irradiation mechanism. As illustrated in FIG. 19, the laser head 213 is fixed at a different location from the IJ head 208, and the laser head 213 does not have to move in conjunction with the IJ head 208. A laser light L1 emitted from the laser head 213 is scanned by the polygon mirror 302 and then shaped into a parallel light by the lens 303, and thereafter, the laser light L1 is reflected by the reflector 301 to irradiate the back side of the substrate 202. Also in the modification, the laser light L1 is irradiated to the back side of the substrate 202, and the same effect as the example illustrated in FIG. 18 can be obtained.

Figure 20:
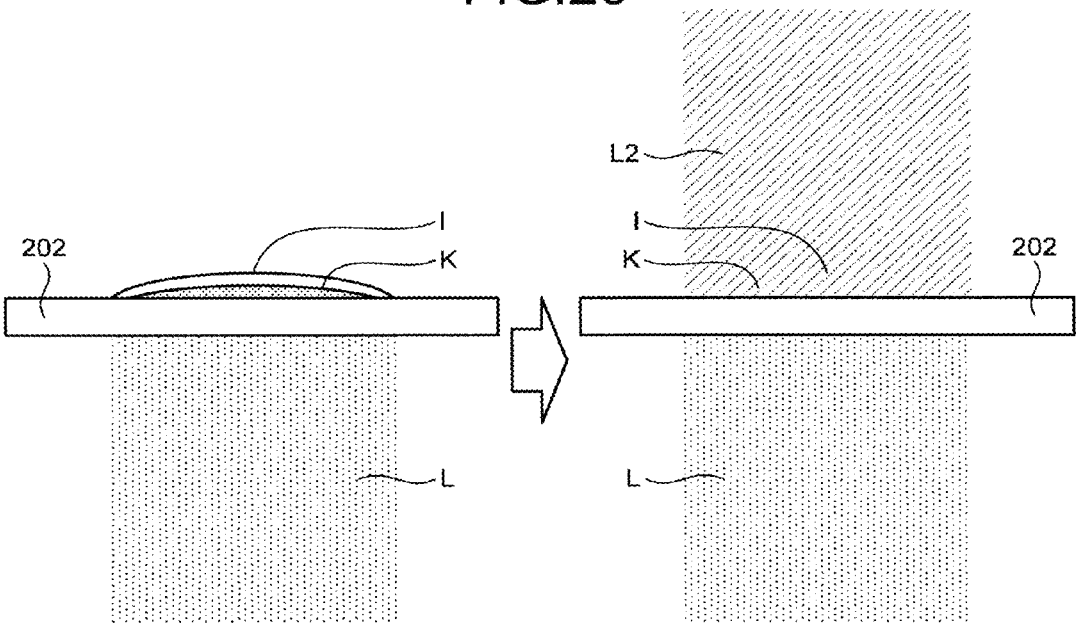
FIG. 20 is a conceptual diagram illustrating an example of irradiation of laser light to the back and front sides of a substrate.
Figure 21:
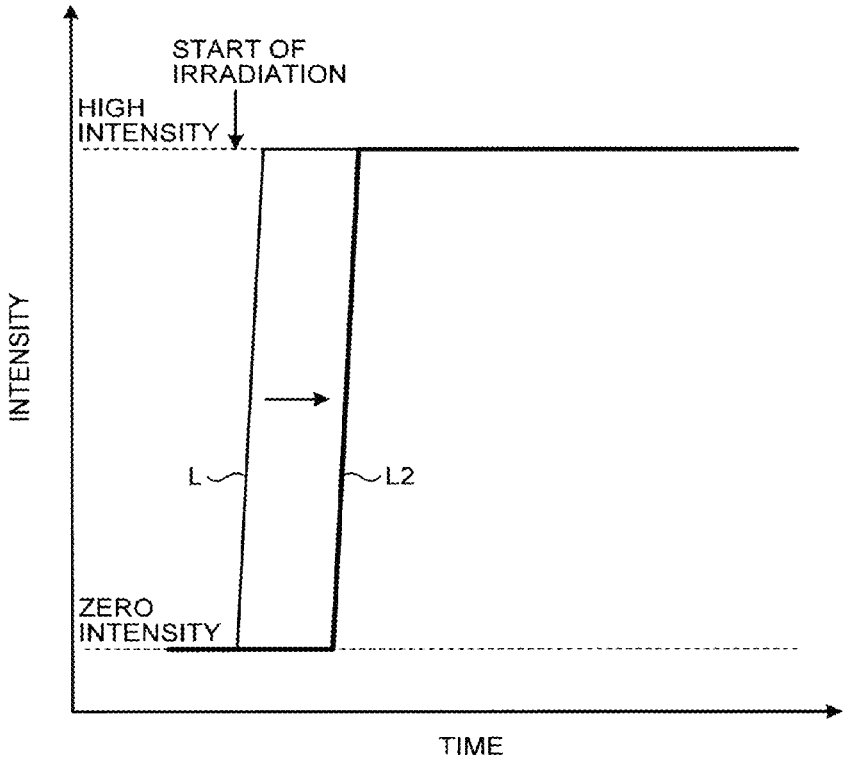
FIG. 21 is a graph showing the relationship between the irradiation timing and intensity of laser light.

FIG. 20 is a conceptual diagram illustrating an example of irradiation of laser light to the back and front sides of the substrate 202. As illustrated in FIG. 20, irradiation of a laser light L and a second laser light L2 to the back and front sides of the substrate 202 is that, first, the laser light L is irradiated to the back side of the area on the substrate 202 onto which an ink drop I has been discharged and then the second laser light L2 is irradiated to the surface of the ink drop I. FIG. 21 is a graph showing the irradiation timing and intensity of laser light. As illustrated in FIG. 21, a time difference for irradiation between the laser light L which is applied to the back side and the second laser light L2 which is applied to the front side depends on an increasing rate of the temperature of the ink drop I heated by laser; however, it is preferable that the time difference is within roughly a few millisecond to a submillisecond. Furthermore, the laser wavelength is preferably within visible light wavelengths to infrared wavelengths. In particular, a range of wavelengths absorbed by a functional material is more preferable. Thus, after the back side of the substrate 202 onto which the ink drop I has been discharged is irradiated with the laser light L, the surface of the ink drop I is irradiated with the second laser light L2, thereby suppressing a crack or ablation due to excessive laser irradiation, and it is possible to realize a smooth and damage-free drying/baking process.

Figure 22:
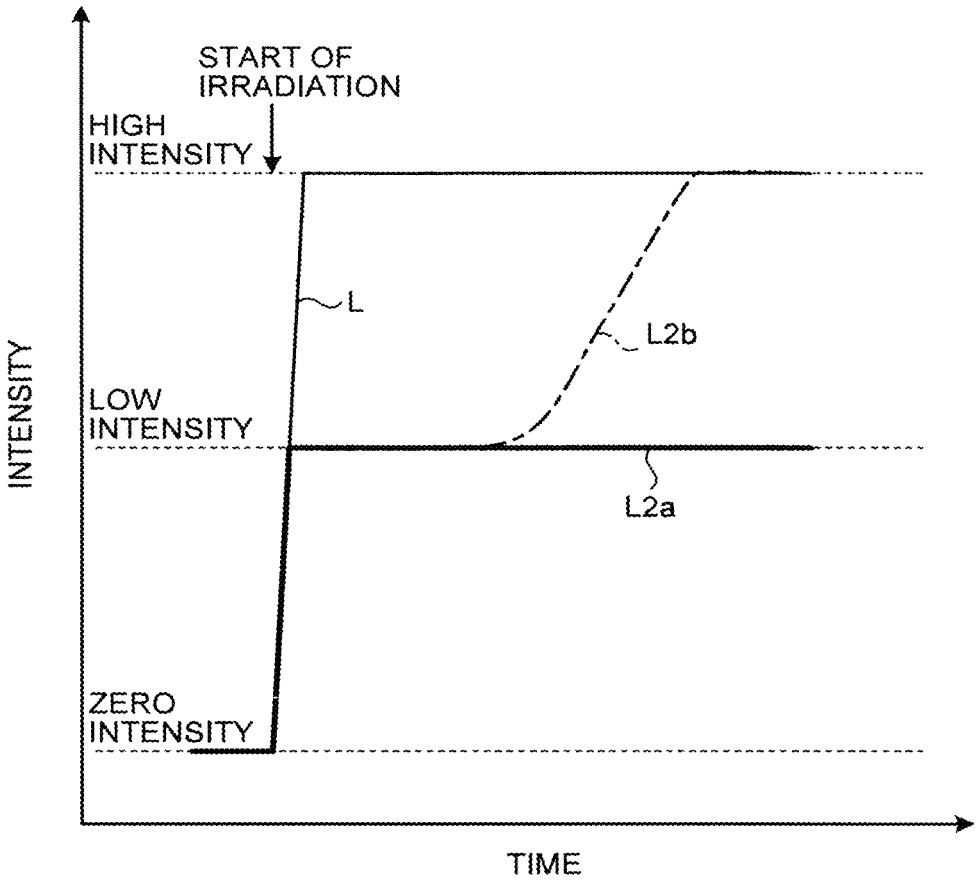
FIG. 22 is a graph showing the relationship between the irradiation timing and intensity of laser light.

Furthermore, even when there is no time difference between the laser light L and the second laser light L2 irradiated to the back side and the front side and the intensity of the laser light L irradiated to the back side is larger than the intensity of the second laser light L2 irradiated to the front side (the intensity of the second laser light L2 irradiated to the front side is smaller than the intensity of the laser light L irradiated to the back side), it is possible to achieve a smooth and damage-free drying/baking process. FIG. 22 is a graph showing the irradiation timing and intensity of laser light. As illustrated in FIG. 22, although the irradiation of the laser lights L and L2*a* are started simultaneously, keeping the relation (the intensity of the laser light L irradiated to the back side)>(the intensity of the second laser light L2*a* irradiated to the front side) enables to suppress a crack or ablation to appear in a drying/baking process. Furthermore, as with the second laser light L2*b* irradiated to the front side, it is preferable to increase energy for the drying/baking process on the front side with time.

The thin-film forming apparatus and the thin-film forming method according to the embodiment can reduce characteristic degradation arising in the ink-jet method.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A thin-film forming apparatus for forming a thin film on a substrate with an ink jet method, the thin-film forming apparatus comprising:

an ink applying unit suitable for applying an ink drop to a predetermined area on a front surface of the substrate; and a laser-light irradiating unit suitable for irradiating a first spot on a back side of the substrate with a laser light from the back side of the substrate, the first spot corresponding to the predetermined area to which the ink drop has been applied, thereby heating the ink drop, wherein the substrate comprises an electrode layer comprising a metal material on the front surface of the substrate, the predetermined area is on or above the electrode layer, the ink drop is a drop of a solution comprising a ferroelectric material, and the laser light has a wavelength having a high coefficient of absorption by the substrate or the electrode layer.

2. The thin-film forming apparatus according to claim 1, wherein the laser-light irradiating unit comprises:

a first laser-light irradiating unit suitable for irradiating the first spot with the laser light from the back side of the substrate, and a second laser-light irradiating unit suitable for irradiating a second spot on the front surface of the substrate with a laser light , wherein the second spot corresponds to the predetermined area applied with the ink drop, the second spot corresponds to a pattern formed by ink drops, and the first spot is larger than the second spot.

3. The thin-film forming apparatus according to claim 1, further comprising:

an imaging unit suitable for taking an image of the surface of the substrate, wherein the thin-film forming apparatus is suitable for aligning a position on the substrate to be applied with the ink drop, and aligning between the predetermined area having been applied with the ink and a spot to be irradiated with the laser light based on an image from the imaging unit.

4. The thin-film forming apparatus according to claim 1, wherein the ink applying unit is suitable for applying a self-assembled monomolecular film material having liquid repellency on the surface of the substrate, and the laser-light irradiating unit is suitable for irradiating at least a portion of the self-assembled monomolecular film material, thereby removing the portion and obtaining a pattern comprising a liquid-repellent portion and a lyophilic portion on the surface of the substrate.

5. The thin-film forming apparatus of claim 1, wherein the ink drop is a drop of a PZT precursor solution.

6. The thin-film forming apparatus of claim 1, wherein the laser light has a wavelength having a high coefficient of absorption by the substrate.

7. The thin-film forming apparatus according to claim 1, wherein the later-light irradiating unit comprises:

a laser head on the front side of the substrate and a reflector on the back side of the substrate, suitable for reflecting laser light emitted from the laser head to the back side of the substrate.

8. The thin-film forming apparatus according to claim 1, wherein the later-light irradiating unit comprises:

a laser head, a polygon mirror, suitable for scanning a laser light emitted from the laser head, a lens, suitable for focusing the laser light into a parallel light, and a reflector on the back side of the substrate, suitable for reflecting the laser light to the back side of the substrate.

9. A thin-film forming method for forming a thin film on a substrate by an ink-jet method, the thin-film forming method comprising:

applying an ink drop to a predetermined area on a front surface of the substrate; and baking the ink drop by irradiating a first spot on a back side of the substrate with a laser light from the back side of the substrate, thereby heating the ink drop, wherein the first spot corresponds to the predetermined area to which the ink drop has been applied, the substrate comprises an electrode layer comprising a metal material on the front surface of the substrate, the predetermined area is on or above the electrode layer, the laser light in the baking is only from the back side of the substrate the ink drop is a drop of a solution comprising a ferroelectric material, and the laser light has a wavelength having a high coefficient of absorption by the substrate or the electrode layer.

10. The thin-film forming method according to claim 9, wherein the applying comprises applying the ink drop to the surface of the substrate with a pattern comprising a liquid-repellent portion and a lyophilic portion.

11. The thin-film forming method according to claim 9, wherein the applying comprises applying a self-assembled monomolecular film material having liquid repellency to the surface of the substrate, and the baking comprises irradiating at least a portion of the monomolecular film with a laser light, thereby removing the portion of the monomolecular film and forming areas of a liquid-repellent portion and a lyophilic portion.

12. A piezoelectric-element forming method, comprising:

forming a piezoelectric element on a substrate by the thin-film forming method according to claim 9.

13. A droplet discharging head, comprising:

a piezoelectric element obtained by a process comprising the piezoelectric-element forming method according to claim 12.

14. An ink-jet recording apparatus, comprising:

the droplet discharging head according to claim 13.

15. The thin-film forming method of claim 9, wherein the ink drop is a drop of a PZT precursor solution.

16. The thin-film forming method of claim 9, wherein the laser light has a wavelength having a high coefficient of absorption by the substrate.

17. The thin-film forming method of claim 9, wherein baking the ink drop by irradiating a first spot on a back side of the substrate with a laser light from the back side of the substrate comprises:

emitting a laser light with a laser head located on a front side of the substrate, and reflecting the laser light to the back side of the substrate with a reflector on the back side of the substrate.

18. The thin-film forming method of claim 9, wherein baking the ink drop by irradiating a first spot on a back side of the substrate with a laser light from the back side of the substrate comprises:

emitting a laser light with a laser head, scanning the laser light with a polygon mirror, focusing the laser light scanned by the polygon mirror into a parallel laser light, reflecting the parallel laser light to the back side of the substrate with a reflector on the back side of the substrate.

19. A thin-film forming method for forming a thin film on a substrate by an ink jet method, the thin-film forming method comprising:

applying an ink drop to a predetermined area on a front surface of the substrate; and baking the ink drop by irradiating a first spot on a back side of the substrate with a laser light from the back side of the substrate, thereby heating the ink drop, wherein the first spot corresponds to the predetermined area to which the ink drop has been applied, the substrate comprises an electrode layer comprising a metal material on the front surface of the substrate, the predetermined area is on or above the electrode layer, the ink drop is a drop of a solution comprising a ferroelectric material, the laser light has a wavelength having a high coefficient of absorption by the substrate or the electrode layer, the baking further comprises, after irradiating the first spot with the laser light, baking the ink drop by irradiating a second spot on the front surface of the substrate with a second laser light, thereby heating the ink drop, and the second spot corresponds to the predetermined area applied with the ink drop.

20. The thin-film forming method according to claim 19, wherein the baking further comprises irradiating the second spot on the front surface of the substrate with a laser light of smaller intensity than the laser light that irradiates the first spot.

* * * * *